US006177788B1

(12) United States Patent
Narendra et al.

(10) Patent No.: US 6,177,788 B1
(45) Date of Patent: Jan. 23, 2001

(54) NONLINEAR BODY EFFECT COMPENSATED MOSFET VOLTAGE REFERENCE

(75) Inventors: Siva G. Narendra, Beaverton; Krishnamurthy Soumyanath, Portland; Vivek K. De, Beaverton, all of OR (US)

(73) Assignee: Intel Corporation, Santa Clara, CA (US)

( * ) Notice: Under 35 U.S.C. 154(b), the term of this patent shall be extended for 0 days.

(21) Appl. No.: 09/470,291

(22) Filed: Dec. 22, 1999

(51) Int. Cl.[7] ..... G05F 3/16
(52) U.S. Cl. ..... 323/315; 323/907
(58) Field of Search ..... 323/907, 315, 323/313, 314

(56) References Cited

U.S. PATENT DOCUMENTS 4,849,684 * 7/1989 Sonntag et al. ..... 323/313
5,493,235 * 2/1996 Khayat ..... 326/34
5,543,746 * 8/1996 Kuo ..... 327/543

* cited by examiner

*Primary Examiner*—Shawn Riley
(74) *Attorney, Agent, or Firm*—Schwegman, Lundberg, Woessner & Kluth, P.A.

(57) ABSTRACT

A nonlinear body effect compensation circuit includes a number of PMOSFETs, each having an identical current flow, with two of the PMOSFETs having different sizes, and two of the PMOSFETs having different body to source voltages. The different body to source voltages of the two PMOSFETs affect the gate to source voltage of the PMOSFETs in a manner that allows compensation of nonlinear body effects as a function of temperature. A voltage proportional to absolute temperature (VPTAT) is generated as a difference between the gate to source voltages of the two PMOSFETs having different sizes, and a voltage not proportional to absolute temperature (VnPTAT) is generated as a difference between the gate to source voltages of the two PMOSFETs having different body to source voltages.

17 Claims, 4 Drawing Sheets

NONLINEAR BODY EFFECT COMPENSATED MOSFET VOLTAGE REFERENCE

FIELD

The present invention relates generally to metal oxide semiconductor field effect transistor (MOSFET) based voltage reference circuits, and more specifically to non-linear temperature compensation in MOSFET based voltage reference circuits.

BACKGROUND

Voltage reference circuits that are process, supply voltage, and temperature (PVT) independent have numerous applications. Applications for which PVT independent voltage reference circuits are used include for example forward body bias and analog to digital conversion, as well as any circuits which require accurate supply voltages over a wide range of operating and device conditions.

Conventional voltage reference circuits requiring PVT independence have traditionally used diode or bipolar junction transistor (BJT) bandgap reference circuits. Circuits such as these typically require a supply voltage of at least 1.3 volts. As technology improves, and components become smaller, the supply voltage ($V_{cc}$) for processors continues to drop. Some current processor are operating with supply voltages of 1.4 volts. This is close to the limit at which diode or BJT bandgap circuits will become ineffective for use as supply voltages due to the silicon bandgap of 1.23 volts.

As processor supply voltages drop, exploration has begun for the use of different technologies to provide lower supply voltages. Metal oxide semiconductor field effect transistors (MOSFETs) in their subthreshold operation have been used to generate bandgap like reference voltages. The use of MOSFETs in such voltage reference circuits lead to non-linear effects that are brought about by several factors. One of the primary contributing factors to non-linearity in MOSFET based voltage reference circuits is the voltage drop across the depletion depth of the MOSFET. In the threshold voltage equation for a MOSFET, this non-linearity manifests as a body effect term, and affects the behavior of the MOSFET in subthreshold operation.

Transistors such as BJTs and MOSFETs have linear and non-linear dependencies that occur based on a number of factors. Those factors include temperature, process, and supply voltage. If the process changes, the output voltage of the circuit and the way the circuit operates will change. Reasons for the change in output voltage include changes due to devices in the circuit, and changes due to temperature. The changes in device behavior are primarily linear in nature. Changes due to temperature typically include linear and non-linear changes.

Other linear and non-linear effects in MOSFET based voltage reference circuits are similar in nature to linear and non-linear effects in BJT based voltage reference circuits. Such effects include linear temperature dependencies and other non-body effect non-linear temperature dependencies. Methods for linear temperature compensation are known. Methods for compensating for non-body effect non-linear temperature dependencies are also known.

Because of the availability of MOSFET devices to operate at voltages less than typical BJT bandgap voltages, and due to the decreasing supply voltages for integrated circuits and especially processors, there is a need in the art for reducing body effect reference voltage variation across temperature in MOSFET reference voltage circuits.

SUMMARY

In one embodiment, a method for non-linear temperature compensation in a MOSFET voltage reference circuit includes compensating for a non-linear body effect of the circuit.

In another embodiment, the non-linear body effect compensation includes generating a voltage not proportional to absolute temperature (VnPTAT), scaling the VnPTAT to match a slope of a gate to source voltage of the first transistor, and adding the scaled VnAPTAT to the gate to source voltage of the first transistor to generate a reference voltage with non-linear temperature dependence.

A circuit for compensating generating terms to non-linearly compensate temperature variation effect in a MOSFET includes a number PMOSFETs each having a identical current flow, with two of the MOSFETS having different sizes, and two other having different body to source voltages.

Other embodiments are described and claimed.

DESCRIPTION OF EMBODIMENTS

In the following detailed description of embodiments, reference is made to the accompanying drawings which form a part hereof, and in which are shown by way of illustration specific embodiments in which the invention may be practiced. These embodiments are described in sufficient detail to enable those skilled in the art to practice the invention, and it is to be understood that other embodiments may be utilized and logical, structural, electrical, and other changes may be made without departing from the scope of the present invention.

Figure 1A:
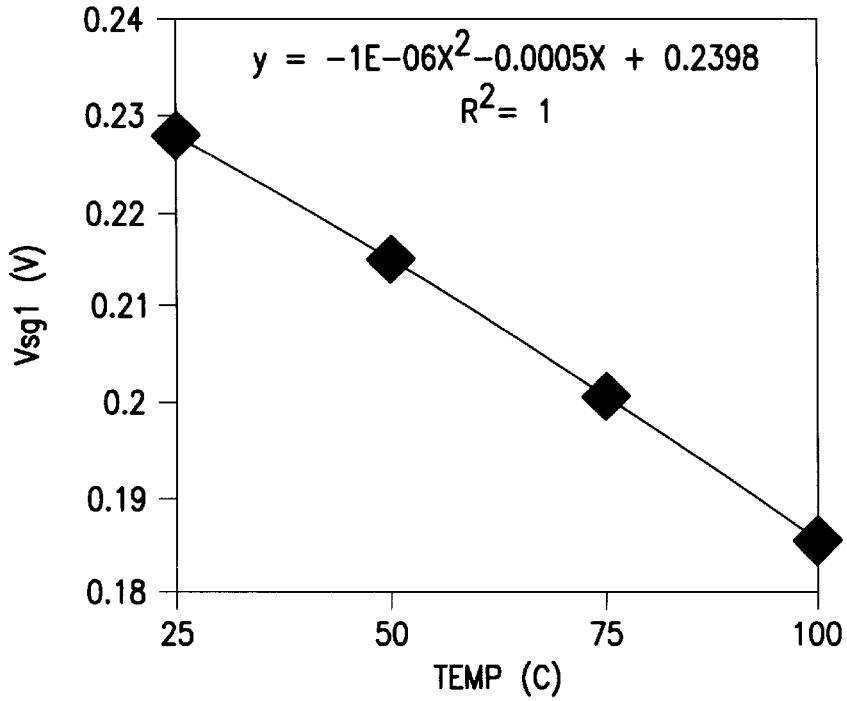
FIG. 1A is a graph of typical temperature dependence of a MOSFET gate to source voltage in subthreshold region.
Figure 1B:
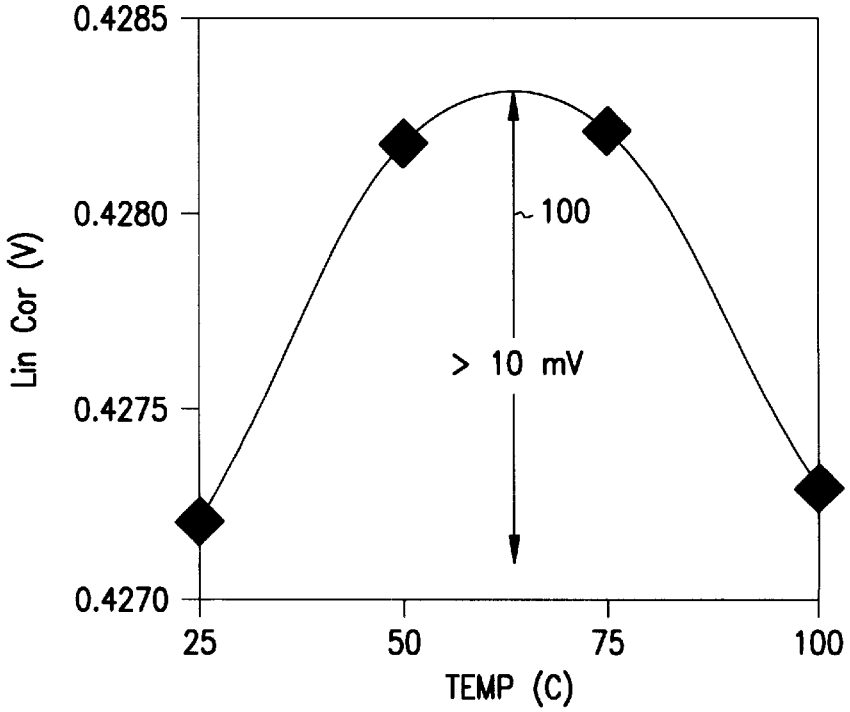
FIG. 1B is a graph of typical linear temperature correction reference voltage of the MOSFET of FIG. 1A.

Temperature compensation for linear dependence of a gate to source voltage $V_{gs}$ of a MOSFET in subthreshold operation (shown in FIG. 1A) is usually accomplished by adding the $V_{gs}$ to a properly scaled voltage proportional to absolute temperature (VPTAT). Subthreshold operation is used since outside of the subthreshold region, because the current and voltage are related quadratically, a VPTAT cannot be obtained. In order to perform linear temperature compensation, when properly scaled, the slope of a properly scaled VPTAT is matched to the slope of the $V_{gs}$. Typically, VPTAT is generated by pushing an identical current through two MOSFETs having different sizes or drain currents or both. In this case, $$VPTAT=V_{gs2}-V_{gs1},$$

where $V_{gs1}$ and $V_{gs2}$ are the gate to source voltages of the two different MOSFETs. The linearly corrected reference voltage in this case is:

$$V_{gs}+kVPTAT,$$

where k is a scaling factor used to match the slopes. A typical linear temperature corrected reference voltage is shown in FIG. 1B. The variation 100 of the reference voltage across temperature is typically on the order of greater than 10 millivolts for a MOSFET based reference voltage generator for the temperature range illustrated in FIG. 1B.

Figure 2:
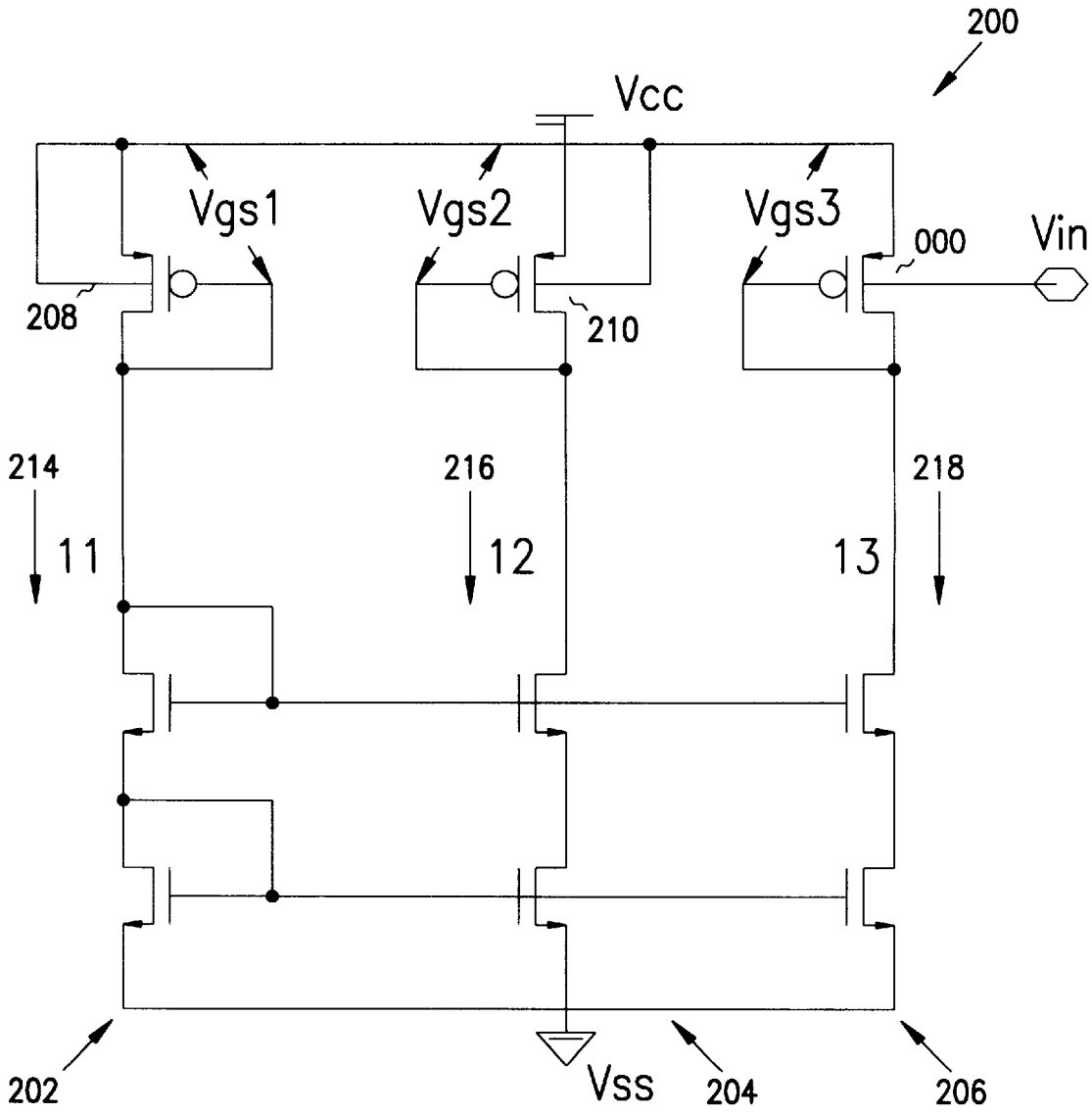
FIG. 2 is a circuit diagram of one embodiment of the present invention.

Once linear temperature compensation has been accomplished, non-linearities remain. As has been mentioned, non-linearities consist of several effects including a body effect term. FIG. 2 is a circuit diagram of an embodiment 200 for generating the voltages and currents necessary for achieving non-linear temperature compensation for a MOSFET based voltage reference circuit. Circuit 200 comprises three legs or limbs 202, 204, and 206, each leg having a P-type MOSFET 208, 210, and 212 respectively, and a pair of N-type MOSFETs. In one embodiment, transistors 210 and 212 are of identical size, with widths W210 and W212 being equal, and lengths L210 and L212 being equal, and transistor 208 is of a different size. Currents I1 indicated by arrow 214, I2 indicated by arrow 216, and I3 indicated by arrow 218 are set by the NMOSFETs to make the PMOSFETs operate in subthreshold region. In this embodiment, all of the NMOS devices are identical, so currents I1, 12, and I3 are identical. A supply voltage $V_{cc}$ and a ground voltage $V_{ss}$ are connected across the legs 202, 204, and 206 as shown.

The equation governing the gate to source voltage for each of the MOSFETs in subthreshold operation is as follows:

$$V_{gs}=V_{t0}+\gamma\sqrt{V_{sb}+\phi},$$

where $\gamma$ is the body effect term, $V_{sb}$ is the source to body voltage, and $\phi$ is a process dependent term.

As has been shown, $$VPTAT=V_{gs2}-V_{gs1}.$$

In this embodiment, $V_{gs2}$ is the gate to source voltage of MOSFET 210 and $V_{gs1}$ is the gate to source voltage of MOSFET 208. As those skilled in the art will recognize, there are several other unique combinations of currents I1 and I2 as well as sizes for MOSFETs 208 and 210 that will also give rise to a VPTAT.

In obtaining the VPTAT, all body effect terms cancel since the source to body voltages of the two MOSFETs 208 and 210 are identical. In order to correct for a body effect term in the VPTAT, the body effect terms for two MOSFETs must be different. If the body effect terms are the same, then in the subtraction, the body effect terms will cancel, and no compensation will be available, as is the case in this embodiment with transistors 208 and 210. The process dependent term $\phi$ is a function of temperature. In a subtraction of the two $V_{gs}$ terms, the $\phi$ terms will cancel. Therefore, in order to be able to compensate for the body effect term, the source to body voltages of the two MOSFETs 210 and 212 are chosen to be different.

Therefore, a voltage not proportional to absolute temperature (VnPTAT) is obtained in this embodiment as follows:

$$VnPTAT=V_{gs3}-V_{gs2}.$$

Figure 3A:
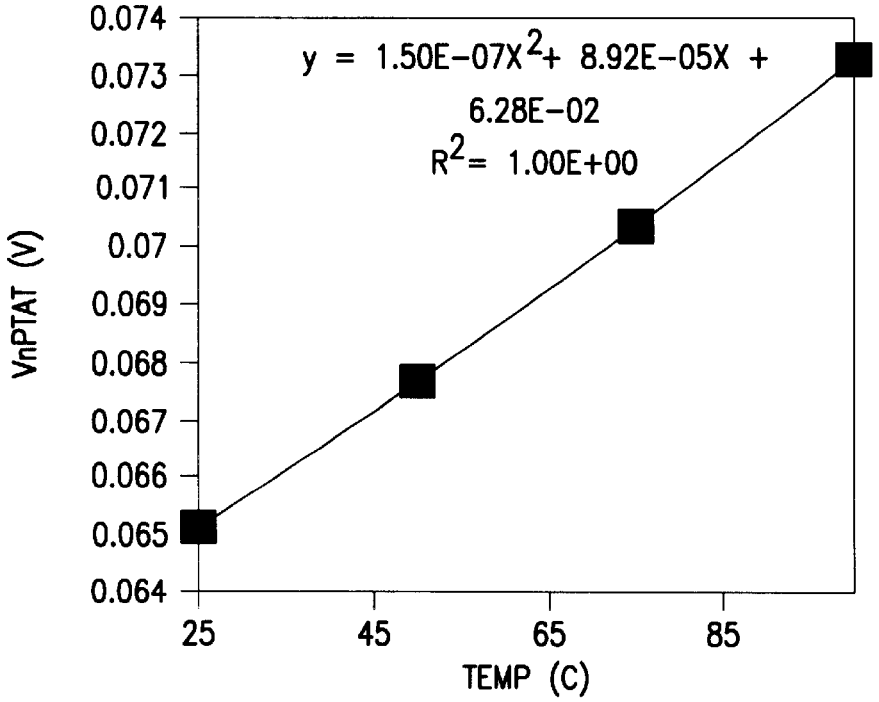
FIG. 3A is a graph of a typical voltage not proportional to absolute temperature for MOSFETs with different body bias voltages.

In this embodiment, since I2=I3, and W210/L210=W212/L212, and $V_{sb2}>V_{sb3}$, the VnPTAT has a body effect term because of the body bias difference between transistor 210 and transistor 212. A typical VnPTAT derived from PMOSFETs with different body bias voltages is shown in FIG. 3A.

Figure 3B:
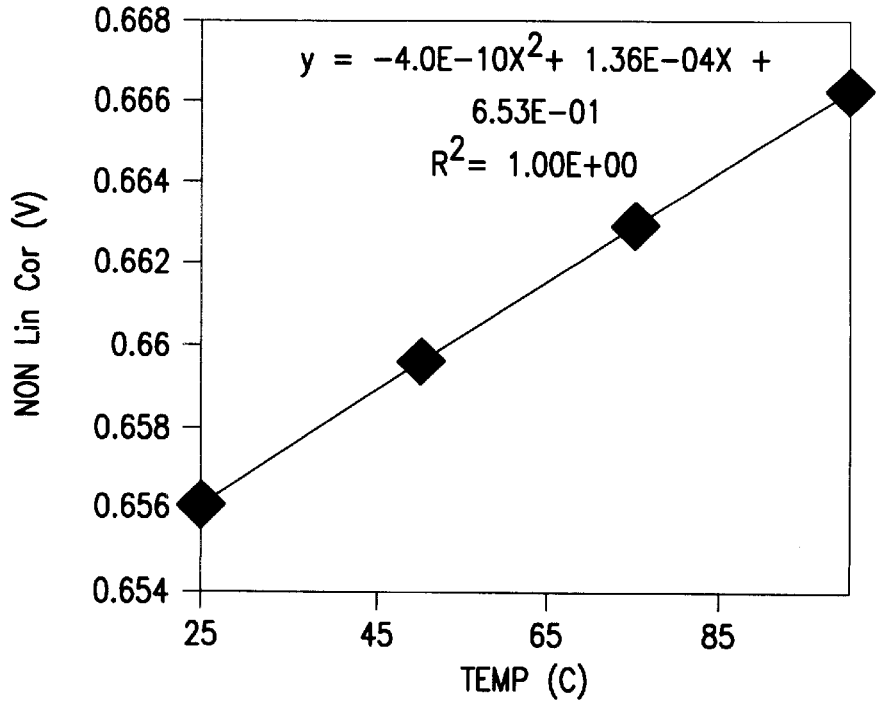
FIG. 3B is a graph of a typical non-linearly corrected reference voltage.

Therefore, three voltages are derived from the circuit 200, namely $V_{gs1}$, VPTAT, and VnPTAT. To compensate for the body effect term, the voltages are scaled so that the slopes match, and terms cancel. In this embodiment, the non-linear coefficient of VnPTAT is scaled so that the slopes of the scaled VnPTAT and $V_{gs1}$ match. The scaled VnPTAT is added to $V_{gs1}$ to obtain a reference voltage with nearly negligible non-linear temperature dependence, as is shown in FIG. 3B. As those skilled in the art will recognize, there are several other unique combinations of currents I2 and I3 as well as body biases for MOSFETs 210 and 212 that will also give rise to a VnPTAT.

Figure 4:
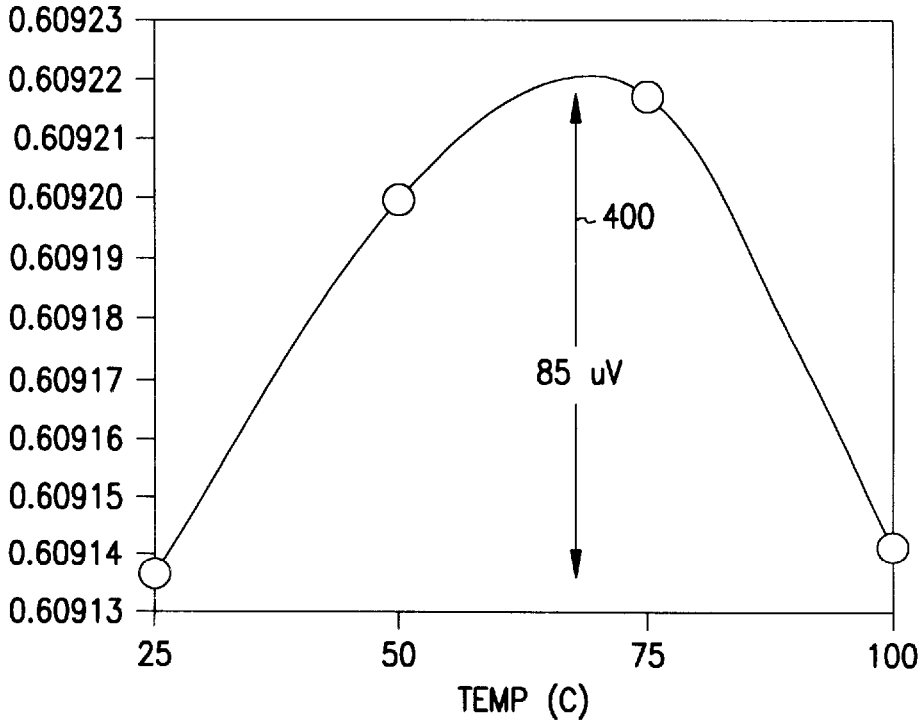
FIG. 4 is a graph of a MOSFET based reference voltage temperature compensated for linear and non-linear body effects.

Once the reference voltage with non-linear compensation is obtained, a linear temperature compensation is performed by scaling VPTAT and add it to the reference voltage. As can be seen from FIG. 3B, the scaling factor for VPTAT is a negative coefficient because the non-linearly compensated voltage increases with temperature. The resultant final reference voltage obtained is shown in FIG. 4. The variation 400 of the final reference voltage across temperature is typically on the order of 85 microvolts, a substantial reduction in variation from the linearly corrected reference voltage of FIG. 3B.

In another embodiment, the circuit 200 is used in combination with a variety of semiconductor devices, including those on a die, such as microprocessors, digital signal processors, communication devices, or the like. Such a circuit 200 is used in this embodiment to provide a MOSFET based body effect compensated reference voltage.

Figure 5:
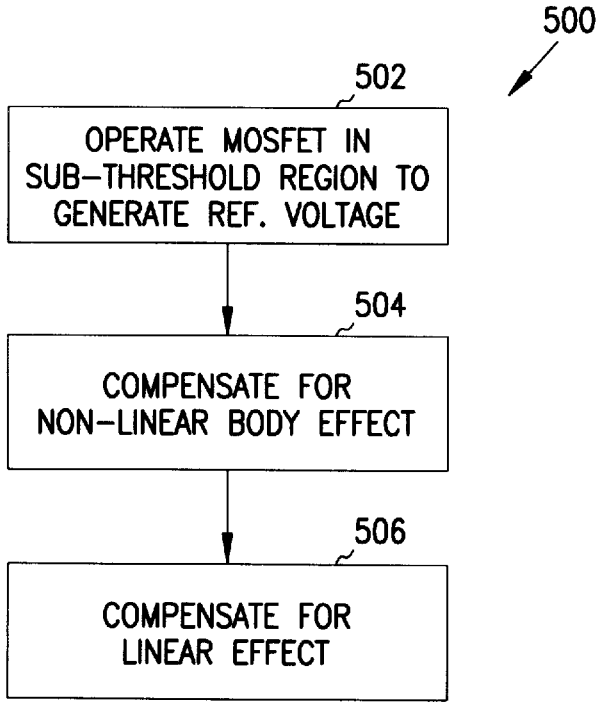
FIG. 5 is a flow chart diagram of a method embodiment of the present invention.

A method embodiment 500 for non-linear compensation of body effect in MOSFET voltage reference circuits is shown in FIG. 5. Method 500 comprises operating a MOSFET in subthreshold operation to generate a reference voltage in block 502, compensating for a non-linear body effect of the MOSFET in block 504, and compensating for a linear temperature effect in the MOSFET in block 506. Operating the MOSFET in subthreshold operation in one embodiment is accomplished by driving a current with MOSFETs of opposite doping as the first MOSFET. Compensating for the linear temperature effect is accomplished by generating a VPTAT as described above, and scaling the VPTAT for addition to a gate to source voltage of the MOSFET.

Non-linear temperature compensation has been described in detail above. In another embodiment, the non-linear temperature compensation comprises obtaining a VnPTAT with a non-linear body effect term, scaling the VnPTAT to match the slope of the gate to source voltage of the first MOSFET ($V_{gs1}$), and adding the scaled VnPTAT and the $V_{gs1}$ to obtain a non-linearly compensated reference voltage. In yet another further embodiment, the VPTAT is scaled to match the slope of the non-linearly compensated reference voltage to obtain a new reference voltage that is both linearly and non-linearly compensated for body effect terms.

Those of skill in the art will understand that numerous techniques applying the various method embodiments discussed herein are available, and are within the scope of the invention. The methods of the present invention will function with a wide variety of circuit topologies.

In various embodiments, the present invention provides for non-linear body effect compensation in MOSFET based voltage reference circuits. Such embodiments are useful in processor circuits where supply voltages are dropping to levels nearing the limits of BJT based bandgap reference voltage circuits. The embodiments provide increased accuracy and decreased reference voltage variation for MOSFET based voltage reference circuits.

The circuits illustrated herein are shown generating a reference voltage with respect to $V_{cc}$. However, a complementary $V_{ss}$, based reference circuit employing the methods of the present invention is well within the scope of one skilled in the art, and within the scope of the invention. Further, while MOSFETs are used to describe the methods and apparatuses of the various embodiments described above, other field effect transistors could be employed in the present invention without departing from the scope of the invention.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. It is intended that this invention be limited only by the following claims, and the full scope of equivalents thereof.

What is claimed is:

1. A circuit for generating terms to non-linearly compensate temperature variation effect in a FET, comprising:

a plurality of first type FETs each having an identical current driven therethrough, wherein two of the FETs have different sizes, and two other of the FETs have different body to source voltages.

2. The circuit of claim 1, wherein the current is selected to operate each of the FETs in its subthreshold region.

3. The circuit of claim 1, further comprising:

a current generator for each of the identical currents, each current generator comprising:

a pair of FETs of opposite type as the first type FETs.

4. The circuit of claim 1, wherein the first type of FET is P-type.

5. A method, comprising:

performing non-linear temperature compensation for a non-linear body effect of a field effect transistor (FET) voltage reference circuit.

6. The method of claim 5, wherein performing compensation for the body effect comprises:

generating a voltage not proportional to absolute temperature (VnPTAT);

scaling the VnPTAT to match a slope of a gate to source voltage of the first transistor; and adding the scaled VnPTAT to the gate to source voltage of the first transistor to generate a reference voltage with non-linear temperature dependence.

7. The method of claim 6, wherein generating the VnPTAT comprises:

applying an identical current to a first and a second transistor, each transistor having a different body bias voltage.

8. The method of claim 7, further comprising:

compensating for a linear temperature effect.

9. The method of claim 8, wherein compensating for the linear temperature effect comprises:

generating a gate to source voltage ($V_{gs1}$) across a first FET;

generating a voltage proportional to absolute temperature (VPTAT) across the first FET and a second FET of a different size;

scaling VPTAT to match a slope of the reference voltage with non-linear temperature dependence; and subtracting the scaled VPTAT with the reference voltage with non-linear temperature dependence to create a second reference voltage that is linearly and non-linearly compensated for body effect.

10. A method, comprising:

operating a FET in subthreshold operation to generate a reference voltage;

compensating for a non-linear body effect in the FET; and compensating for a linear temperature effect of the FET.

11. The method of claim 10, wherein compensating for the non-linear body effect comprises:

generating a voltage not proportional to absolute temperature (VnPTAT) across the second FET and a third FET, the second and the third FETs having different source to body voltages;

scaling VnPTAT to match a slope of $V_{gs1}$;

adding the scaled VnPTAT to $V_{gs1}$ to create a reference voltage with non-linear temperature dependence.

12. The method of claim 11, wherein compensating for the linear temperature effect comprises:

generating a gate to source voltage ($V_{gs1}$) across the FET;

generating a voltage proportional to absolute temperature (VPTAT) across the FET and a second FET of a different size;

scaling VPTAT to match a slope of the reference voltage with non-linear temperature dependence; and subtracting the scaled VPTAT with the reference voltage with non-linear temperature dependence to create a second reference voltage that is linearly and non-linearly compensated for body effect.

13. A method for generating a FET reference voltage, comprising:

generating a gate to source voltage ($V_{gs}$) across a first PFET;

generating a non-linear temperature dependent voltage (VnPTAT);

generating a voltage proportional to absolute temperature (VPTAT);

scaling the VnPTAT to match a slope of the Vgs and adding the scaled VnPTAT to the Vgs to generate a first reference voltage;

scaling the VPTAT to match a slope of the first reference voltage and adding the scaled VPTAT to the first reference voltage.

14. The method of claim 13, wherein generating a voltage proportional to absolute temperature (VPTAT) comprises driving identical currents across the first PFET and a second PFET of a different size.

15. The method of claim 13, wherein generating the VnPTAT comprises:

driving an identical current across a second PFET and a third PFET, each of the second and the third PFETs having a different body bias voltage.

16. A die having a FET based voltage reference circuit, the circuit comprising:

three PFETs each having a first current driven therethrough, the first PFET and the second PFET having different sizes, and the second and the third PFETS having different body to source voltages;

three current sources each to create the first current in one of the PFETs to force PFET operation in a subthreshold region.

17. The die of claim 16, wherein each of the FETs is a MOSFET.

* * * * *